United States Patent [19]

Economopoulos

[11] 4,295,902

[45] Oct. 20, 1981

[54] METHOD OF MANUFACTURING ROLLED STEEL PRODUCTS WITH HIGH ELASTIC LIMIT

[75] Inventor: Marios Economopoulos, Liege, Belgium

[73] Assignee: Centre de Recherches Metallurgiques-Centrum voor Research in de Metallurgie, Brussels, Belgium

[21] Appl. No.: 124,794

[22] Filed: Feb. 26, 1980

[30] Foreign Application Priority Data

Feb. 28, 1979 [BE] Belgium ..... 874535

[51] Int. Cl.[3] ..... C21D 1/18; C22C 38/46

[52] U.S. Cl. ..... 148/144; 75/128 V; 148/39

[58] Field of Search ..... 148/12 B, 12.4, 39, 148/156, 36, 144

[56] References Cited

U.S. PATENT DOCUMENTS

| | | | |
|---|---|---|---|
| 3,666,572 | 5/1972 | Nakagawa et al. | 148/12.4 X |
| 4,016,009 | 4/1977 | Economopoulos | 148/156 X |
| 4,016,015 | 4/1977 | Respen et al. | 148/39 |

*Primary Examiner*—Peter K. Skiff

*Attorney, Agent, or Firm*—Holman & Stern

[57] ABSTRACT

A rolled steel product is given an elastic limit of 500 to 1200 MPa by selection of a particular steel composition and a particular heat treatment. The steel contains 0.10–0.50% C, 0.90–1.50% Mn, and 0.10–0.45% Si, and optionally 0.20–0.70% Ni, 0.10–0.80% Cr, and 0.02–0.10% V. The heat treatment consists of surface quenching from above the austenitization temperature by means of a fluid, the heat remaining in the product being sufficient to temper the martensite and/or bainite in the quenched surface.

4 Claims, No Drawings

METHOD OF MANUFACTURING ROLLED STEEL PRODUCTS WITH HIGH ELASTIC LIMIT

FIELD OF THE INVENTION

The present invention relates to a method of manufacturing rolled steel products with an elastic limit of 500 to 1200 MPa; these products may be concrete reinforcing rods, wire rod, bars of circular or non-circular section, sections, constituted essentially by a flat or by several flats rigidly joined together, sheet bars, and sheets.

BACKGROUND OF THE INVENTION

The main qualities which consumers require from rolled steel products are, inter alia, an elastic limit which is as high as possible for the grade of steel used and, according to the conditions and use for which the product is intended, fatigue strength, ductility, weldability, and perhaps drawability of a satisfactory quality.

Obtaining these qualities requires, among other things, the use of a method of hardening either by precipitation, for example by means of the addition of alloying elements, or by work-hardening, for example by drawing or cold-twisting. However, these two known methods have the disadvantage of being costly.

The object of the present invention is a method which enables the above drawback to be obviated, as a result of the adaptation of a heat treatment to the composition of the steel in order to create suitable metallic microstructures.

SUMMARY OF THE INVENTION

The present invention provides a method of manufacturing a rolled steel product having a high elastic limit of 500 to 1200 MPa, in which, from above the austenitization temperature of a rolled steel product containing 0.10% to 0.50% of carbon, 0.90% to 1.50% of manganese, and 0.10% to 0.45% of silicon, the product is subjected to intense cooling by means of a fluid in such a way that martensitic and/or bainitic quenching of the surface layer of all or part of the product is achieved, whereas the non-quenched portion of the product remains at a temperature which is sufficient to enable subsequent tempering of the surface layer of martensite and/or bainite to be obtained (self-tempering).

The intense cooling is advantageously applied to the rolled product on its discharge from the finishing stand of the hot rolling mill.

According to an embodiment of the invention, a rolled product having an elastic limit of 500 to 800 MPa is manufactured with a thickness and diameter lower than 50 mm from a steel containing 0.30% to 0.50% C, 0.90% to 1.10% Mn, and 0.10 to 0.30% Si.

According to a further embodiment of the invention, the rolled steel product in addition contains 0.20% to 0.70% Ni, 0.10 to 0.80% Cr, and 0.02 to 0.10% V. Within the scope of this embodiment, a rolled product having an elastic limit of 500 to 800 MPa is manufactured with a thickness and diameter higher than 50 mm from a steel containing 0.10% to 0.30% C, 1.20% to 1.40% Mn, 0.10% to 0.30% Si, 0.40% to 0.70% Ni, 0.40% to 0.80% Cr, 0.02% to 0.10% V. Also within the scope of this embodiment, a rolled product with an elastic limit of 800 to 1200 MPa is manufactured from a steel containing 0.30% to 0.50% C, 1.20% to 1.40% Mn, 0.15% to 0.45% Si, 0.20% to 0.60% Ni, 0.10% to 0.40% Cr, 0.02% to 0.06% V.

The cooling fluid used for carrying out the method is generally water, with or without additives, or aqueous solutions of mineral salts etc. The fluid may be an atomised liquid or mist, for example water suspended in a gas, for example air. The fluid may itself be a gas, for example steam.

From the point of view of practice, the required rapid cooling of the product is obtained by selection of the cooling devices and by the suitable adjustment of the length and the flow characteristics of the cooling ramps.

The above method provides the following advantages:

- improved physical properties,
- economical use of alloying elements,
- reduction of heat treatment costs,
- the possibility of reducing the number of steel grades to be produced in the steelworks in order to obtain the required properties.
- the possibility of obviating the production of certain non-standardised steel grades (wide-ranging flexibility of adaptation).

EXAMPLES

The following examples are given to illustrate the advantages provided by the method of the present invention.

EXAMPLE 1.

Steel bars of various dimensions (10, 15, 20, 30, 40, 45 mm) lower than 50 mm were used, having the following average chemical composition: 0.40% C, 1.20% Mn, and 0.20% Si, the balance being constituted by Fe having the normal impurities.

On discharge from the final stand of the hot rolling mill at above the austenitization temperature, the bars were subjected to rapid quenching of the surface layer followed by self-tempering, in accordance with the present invention.

The bars treated in this way had an elastic limit at about 500 MPa.

In order to obtain an elastic limit of this order with steel bars subjected to a conventional heat treatment (ordinary quenching + tempering), use had to be made of steels whose chemical composition was in the range 0.38 to 0.43% C, 0.85 to 1.10% Mn, 0.40 to 0.60% Si, and 0.40 to 0.05% V. The economical use of the elements C and Si provided by the method of the invention may therefore be observed, and in addition the absence of vanadium, which is required in the case of conventional heat treatments.

Comparative tests on the two types of heat treatment (present invention versus conventional) carried out on steel bars having the same chemical composition (0.40% C, 1.20% Mn, 0.20% Si) demonstrated an elastic limit difference of approximately 100 MPa in favour of the treatment of the invention which illustrates the improvement in quality provided by this treatment.

The improvement of the quality is also shown in a more general way by improved ductility (increased elongation and bending strength).

EXAMPLE 2.

In another series of tests, steel bars of diameters higher than 50 mm were used, having the following average chemical composition: 0.20% C, 1.30% Mn, 0.20% Si, 0.50Ni, 0.60% Cr, and 0.06% V, the balance being constituted by Fe containing the usual impurities.

On discharge from the final stand of the hot rolling mill at above the austenitization temperature, these bars were also subjected to rapid quenching of the surface layer followed by self-tempering, in accordance with the method of the present invention.

The bars treated in this way had an elastic limit of approximately 750 MPa.

In order to obtain this elastic limit with steel bars subjected to a known heat treatment (ordinary quenching + tempering), use had to be made of steel bars whose chemical composition was 0.25% to 0.29% C, 1.20% to 1.40% Mn, 0.15% to 0.30% Si, 0.40% Cu, 0.70% Ni, 0.60% Cr, 0.06% V.

It should be noted that the method of the invention provides an economical use of the elements C and Si and in addition an economical use of the alloying elements such as Cu and Ni, which are required in the case of known heat treatment.

In respect of the economy of thermo-mechanical treatment costs, the bars subjected to the known treatment must, in addition, be subjected to drawing and annealig in order to obtain the required strength. However, these operations are unnecessary after application of the method of the invention.

EXAMPLE 3

This example is intended to illustrate the cost economy in respect of alloying elements and heat treatments provided by the method of the invention.

In the same way as in Examples 1 and 2, steel bars of diameters between 26 and 32 mm and of varying chemical compositions were treated, on one hand, in accordance with the method of the present invention and, on the other hand, in accordance with a known heat treatment method, in order to achieve the same elastic limit of approximately 1100 MPa, with the result that the following compositions were obtained:

| Chemical composition | Invention | Known heat treatment |
|---|---|---|
| C % | 0.40 | 0.50–0.54 |
| Mn % | 1.30 | 1.25–1.50 |
| Si % | 0.30 | 0.50–0.70 |
| Ni % | 0.40 | 0.35–0.45 |

-continued

| Chemical composition | Invention | Known heat treatment |
|---|---|---|
| Cr % | 0.25 | 0.20–0.30 |
| V % | 0.04 | 0.08–0.09. |

The above figures illustrate the considerable economy obtained with the alloying elements.

In respect of economy of treatment costs, the bars subjected to the known treatment must in addition undergo drawing and annealing in order to ensure the required strength. However, these operations are not necessary after application of the method of the invention.

It should also be noted that the method of the invention is applicable with steel compositions having comparatively large carbon and manganese contents.

I claim:

1. A method of manufacturing a rolled steel product having an elastic limit in the range from about 500 to about 1200 MPa, the method comprising subjecting a rolled steel product to intense cooling from above its austenitization temperature in such a way that at least part of the surface of the product is subjected to martensitic and/or bainitic quenching while the remainder of the product stays at a temperature sufficient to allow tempering of the quenched surface to occur subsequently by conduction of heat from the said remainder to the quenched surface, the rolled steel product containing 0.10 to 0.50% C, 0.90 to 1.50% Mn, 0.10 to 0.45% Si, 0.20 to 0.70% Ni, 0.10 to 0.80% Cr, and 0.02 to 0.10% V.

2. A method as claimed in claim 1, in which the rolled steel product is a hot rolled product emerging from a finishing stand of a hot rolling mill.

3. A method as claimed in claim 1, in which the rolled steel product has a thickness and diameter greater than 50 mm and contains 0.10 to 0.30% C, 1.20 to 1.40% Mn, 0.10 to 0.30% Si, 0.40 to 0.70% Ni, 0.40 to 0.80% Cr, and 0.02 to 0.10% V, the resulting product having an elastic limit in the range from about 500 to about 800 MPa.

4. A method as claimed in claim 1, in which the rolled steel product contains 0.30 to 0.50% C, 1.20 to 1.40% Mn, 0.15 to 0.45% Si, 0.20 to 0.60% Ni, 0.10 to 0.40% Cr, and 0.02 to 0.06% V, the resulting product having an elastic limit in the range from about 800 to about 1200 MPa.

* * * * *